US010614771B2

(12) United States Patent
Pincenti et al.

(10) Patent No.: US 10,614,771 B2
(45) Date of Patent: Apr. 7, 2020

(54) MANAGING IMAGE QUALITY IN A DISPLAY

(71) Applicant: MOTOROLA MOBILITY LLC, Chicago, IL (US)

(72) Inventors: John C. Pincenti, Chicago, IL (US); Jason Knopsnyder, Crystal Lake, IL (US); Shawn M. Jones, Cary, IL (US); Martin R. Pais, North Barrington, IL (US)

(73) Assignee: Motorola Mobility LLC, Chicago, IL (US)

( * ) Notice: Subject to any disclaimer, the term of this patent is extended or adjusted under 35 U.S.C. 154(b) by 33 days.

(21) Appl. No.: 16/009,401

(22) Filed: Jun. 15, 2018

(65) Prior Publication Data

US 2019/0385564 A1 Dec. 19, 2019

(51) Int. Cl.
*G09G 5/02* (2006.01)
*G09G 5/00* (2006.01)

(52) U.S. Cl.
CPC ..... *G09G 5/003* (2013.01); *G09G 5/02* (2013.01); *G09G 2320/041* (2013.01); *G09G 2320/0666* (2013.01)

(58) Field of Classification Search
CPC ..... G09G 5/02; G09G 2320/0666; G09G 2340/06; G09G 2320/0242; G09G 2320/0626; G09G 2320/0673; G09G 2330/021; G09G 2320/0285; G09G 5/06; G09G 2320/041; G09G 2320/0233; G09G 5/10; G09G 2320/0276; G09G 3/3406; G09G 5/026; H04N 1/60; H04N 1/6077; H04N 1/6027; H04N 1/6091; H04N 5/2354; H04N 9/3111; H04N 9/3155; H04N 9/3164; H04N 9/3182; H04N 9/643; H04N 9/69
USPC ..... 345/102
See application file for complete search history.

(56) References Cited

U.S. PATENT DOCUMENTS

2010/0245857 A1* 9/2010 Plummer ..... H04N 1/603 358/1.9
2014/0139571 A1* 5/2014 Albrecht ..... G09G 5/02 345/694

OTHER PUBLICATIONS

The Society of Motion Picture and Television Engineers, High Dynamic Range Electro-Optical Transfer Function of Mastering Reference Displays, SMPTE ST 2084:2014, 2014.

* cited by examiner

*Primary Examiner* — Duc Q Dinh
(74) *Attorney, Agent, or Firm* — Yudell Isidore PLLC

(57) ABSTRACT

A method, a system, and a computer program product for managing image quality of an electronic display. The method includes identifying a visual content encoded in a first color space that is to be presented on an electronic display. The method further includes identifying, for the electronic display, a color profile that specifies color tristimulus values for the electronic display that are expressed as a function of temperature. The method further includes determining a current temperature of the electronic display and applying the color profile to the visual content to create a modified visual content for presentation on the electronic display. The method further includes rendering the modified visual content by the electronic display and adjusting, during rendering of the modified visual content, the color tristimulus values of the modified visual content in real-time based on the current temperature.

20 Claims, 7 Drawing Sheets

MANAGING IMAGE QUALITY IN A DISPLAY

BACKGROUND

1. Technical Field

The present disclosure generally relates to electronic devices and in particular to a method for managing image quality in a display.

2. Description of the Related Art

Many modern electronic devices, such as notebook computers and cellular phones, are equipped with displays. However, these displays generate heat which may negatively impact the operation of the electronic device and/or lead to user discomfort. For example, colors presented by a display may change as a device's temperature rises. Additionally, the display may become damaged at particularly high power levels and/or heat levels. In many modern electronic devices, when the temperature of a display device exceeds a threshold level, the electronic device self-regulates the drive power applied to the display to mitigate operating characteristics of the display in order to prolong the display's life. However, by regulating the display, the optical performance and user experience delivered by the display is reduced.

BRIEF DESCRIPTION OF THE DRAWINGS

The description of the illustrative embodiments is to be read in conjunction with the accompanying drawings. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
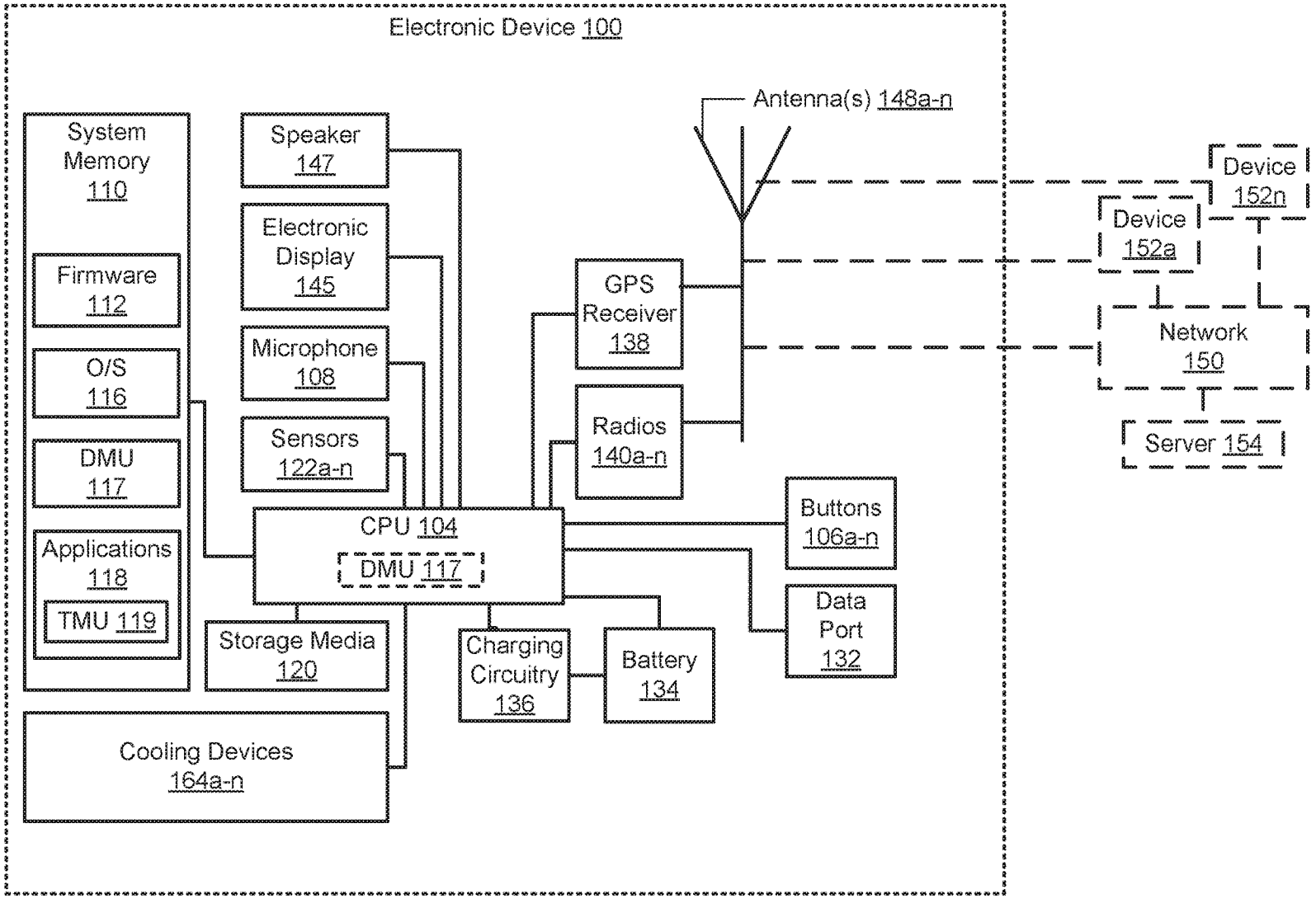
FIG. 1 illustrates an example electronic device within which certain aspects of the disclosure can be practiced, in accordance with one or more embodiments.

The illustrative embodiments provide a method, a system, and a computer program product for managing image quality of an electronic display. The method includes identifying a visual content encoded in a first color space that is to be presented on an electronic display. The method further includes identifying a color profile for the electronic display having color tristimulus values that are expressed as a function of temperature. The method further includes determining a current temperature of the electronic display and applying the color profile to the visual content to create a modified visual content for presentation on the electronic display. The color profile corrects tristimulus values of the visual content to ensure that color content in the modified visual content presented on the electronic display is true to color content in the visual content. The method further includes rendering the modified visual content by the electronic display and adjusting, during rendering of the modified visual content, the color tristimulus values of the modified visual content in real-time based on the current temperature.

The above contains simplifications, generalizations and omissions of detail and is not intended as a comprehensive description of the claimed subject matter but, rather, is intended to provide a brief overview of some of the functionality associated therewith. Other systems, methods, functionality, features, and advantages of the claimed subject matter will be or will become apparent to one with skill in the art upon examination of the following figures and the remaining detailed written description. The above as well as additional objectives, features, and advantages of the present disclosure will become apparent in the following detailed description.

In the following description, specific example embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from the general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others.

Similarly, various aspects are described which may be aspects for some embodiments but not other embodiments.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Moreover, the use of the terms first, second, etc. do not denote any order or importance, but rather the terms first, second, etc. are used to distinguish one element from another.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be provided its broadest interpretation given the context in which that term is utilized.

Those of ordinary skill in the art will appreciate that the hardware components and basic configuration depicted in the following figures may vary. For example, the illustrative components within the below described electronic device 100 (FIG. 1) are not intended to be exhaustive, but rather are representative to highlight components that can be utilized to implement the present disclosure. Other devices/components may be used in addition to, or in place of, the hardware depicted. The depicted example is not meant to imply architectural or other limitations with respect to the presently described embodiments and/or the general disclosure.

Within the descriptions of the different views of the figures, the use of the same reference numerals and/or symbols in different drawings indicates similar or identical items, and similar elements can be provided similar names and reference numerals throughout the figure(s). The specific identifiers/names and reference numerals assigned to the elements are provided solely to aid in the description and are not meant to imply any limitations (structural or functional or otherwise) on the described embodiments.

Now turning to FIG. 1, there is illustrated an example electronic device 100 within which one or more of the described features of the various embodiments of the disclosure can be implemented. In one embodiment, electronic device 100 can be any electronic device that is equipped with at least one display. For example, electronic device 100 can include, but is not limited to, a data processing system, virtual reality headsets, entertainment devices, gaming devices, a desktop computer, a monitor, a notebook computer, a mobile/cellular phone, a mobile/cellular phone accessory, a digital camera, a video recorder, or a tablet computer. Electronic device 100 includes central processing unit (CPU) 104. CPU 104 may be a single CPU containing one or a plurality of cores, each of which is capable of independent processing. In another embodiment, CPU 104 includes multiple CPUs. In another embodiment, CPU 104 may include a graphical processing unit (GPU), a general purpose graphical processing unit (GPGPU), and/or a digital signal processor (DSP). In still another embodiment, electronic device 100 includes a GPGPU and/or DSP that is separate from CPU 104. CPU 104 is coupled to storage media 120 and system memory 110, within which firmware 112, operating system (05) 116, display management utility (DMU) 117, and applications 118 can be stored for execution by CPU 104. According to one aspect, DMU 117 executes within electronic device 100 to perform the various methods and functions described herein. In one or more embodiments, DMU 117 manages image quality of visual content rendered by an electronic display. For example, DMU 117 may modify tristimulus values of a visual content based on thermal conditions of electronic device 100 and/or electronic display 145 to ensure that while the visual content is being rendered on electronic display 145, color content rendered on electronic display 145 is true to color content in the source visual content. For simplicity, DMU 117 is illustrated and described as a stand-alone or separate software/firmware/logic component, which provides the specific functions and methods described below. However, in at least one embodiment, DMU 117 may be a component of, may be combined with, or may be incorporated within firmware 112, OS 116, and/or within one or more of applications 118.

Applications 118 include thermal management utility (TMU) 119, which provides cooling profiles that are dynamically applied to active cooling devices 164*a-n* and/or other components of electronic device 100 (e.g., CPU 104) to dissipate heat generated by components (e.g. CPU 104) of electronic device 100. TMU 119 may autonomously select a particular cooling profile from among a plurality of cooling profiles based on current thermal conditions of electronic device 100. For example, TMU 119 may increase a cooling rate of active cooling device 164 as a current temperature of CPU 104 rises by increasing a fan speed associated with active cooling device 164. TMU 119 may also adjust an operational mode of components (e.g., CPU 104) of electronic device 100 based on thermal conditions of electronic device 100. For example, if thermal conditions within electronic device 100 exceed a predetermined threshold, TMU 119 may decrease a clock speed of CPU 104 and/or increase a cooling rate associated with active cooling device 164. In one embodiment, DMU 117 is an added utility provided as an extension of and/or within TMU 119.

As shown, electronic device 100 may include input devices and output devices that enable a user to interface with device 100. Those input devices and output devices can include microphone 108, hardware buttons 106*a-n*, and speaker 147. Microphone 108 may be used to receive spoken input/commands from a user. In one embodiment, microphone 108 includes multiple microphones. Hardware buttons 106*a-n* are selectable buttons which are used to receive manual/tactile input from a user to control specific operations of electronic device 100 and/or of applications executing thereon. In one embodiment, hardware buttons 106*a-n* may also include, or may be connected to, one or more sensors (e.g. a fingerprint scanner) and/or hardware buttons 106*a-n* may be pressure sensitive. Hardware buttons 106*a-n* may also be directly associated with one or more functions of a graphical user interface (not pictured) and/or functions of an OS, an application, or hardware of electronic device 100. In one embodiment, hardware buttons 106*a-n* may include a keyboard. Speaker 147 is used to output audio. In one embodiment, speaker 147 includes multiple speakers.

CPU 104 is also coupled to sensors 122*a-n* and electronic display 145. Sensors 122*a-n* can include, but are not limited to including, at least one of: thermal/temperature sensors, noise sensors, motion sensors and/or accelerometers, proximity sensors, and/or camera sensors. Electronic display 145 comprises at least one electronic component and/or electronic module that is capable of displaying visual content such as text, media content, including images and video, and/or a graphical user interface (GUI) associated with or generated by firmware and/or one or more applications executing on electronic device 100. For example, electronic display 145 can include at least one of a liquid crystal display (LCD), an active-matrix organic light-emitting diode (AMOLED) display, or a light-emitting diode (LED) array. Electronic display 145 can include at least one component that generates heat as a byproduct, such as a linear strip of LEDs, at least one lamp/light bulb, a plurality, and/or multiplicity of LEDs. In one embodiment, electronic display 145 includes at least one internal display/monitor of electronic device 100. In another embodiment, electronic display 145 includes a projector module and/or a lamp assembly for projecting visual content and/or display media onto a remote surface (such as a wall or projection screen). In another embodiment, electronic display 145 includes at least one external display, such as a remotely-connected monitor, which is connected to electronic device 100 via a wired and/or wireless connection. In still another embodiment, electronic display 145 is a removable accessory that can be physically attached/coupled to electronic device 100. The GUI can be rendered for viewing on electronic display 145 by CPU 104, in one embodiment, or can be rendered by a GPU (not illustrated), in another embodiment. In one or more embodiments, electronic display 145 is a touch screen that is also capable of receiving touch/tactile input from a user of electronic device 100, such as when the user is interfacing with a displayed (or partially displayed) GUI. In at least one embodiment, electronic device 100 can include a plurality of virtual buttons or affordances that operate in addition to, or in lieu of, hardware buttons 106*a-n*. For example, electronic device 100 can be equipped with a touch screen interface and provide, via a GUI, a virtual keyboard or other virtual icons for user interfacing therewith.

As shown, electronic device 100 also includes cooling devices 164. In one embodiment, cooling device 164 include at least one passive cooling device for dissipating heat generated by at least one heat-generating component of electronic device 100 to an environment of electronic device 100. Passive cooling devices may include a heat sink, for example. In another embodiment, cooling devices 164 includes at least one active cooling device that is used to cool at least one heat-generating component of electronic device 100 and transfer heat generated by the at least one component to a surrounding environment, external to electronic device 100. Active cooling devices can include, but are not limited to: thermoelectric cooling devices, electromagnetic cooling devices, oscillatory cooling devices, forced liquid cooling devices, and/or forced air/gas cooling devices, such as radial/rotary fans and blowers. Active cooling devices can include motors and/or moving components that generate air-based noise and/or mechanical/vibrational noise which may be audible to a user of electronic device 100.

Electronic device 100 also includes data port 132 (e.g., a universal serial bus (USB) port), battery 134, and charging circuitry 136. Data port 132 can operate as a charging port that receives power via an external charging device (not pictured) for charging battery 134 via charging circuitry 136. Data port 132 can operate as a charging port that provides power to an external device that is connected to data port 132 for charging a battery (not pictured) of the external device via charging circuitry 136. Battery 134 may include a single battery or multiple batteries for providing power to components of electronic device 100. In at least one embodiment, battery 134 includes at least one battery that is removable and/or replaceable by an end user. In another embodiment, battery 134 includes at least one battery that is permanently secured within/to electronic device 100. Data port 132 may also function as one of an input port, an output port, and a combination input/output port.

Electronic device 100 may also include global positioning satellite (GPS) receiver 138 and one or more wireless radios 140*a-n*. GPS 138 may be coupled to at least one of antenna(s) 148*a-n* to enable electronic device 100 to determine its current location and/or rate of travel. Wireless radios 140*a-n* may be coupled to one or more of antenna(s) 148*a-n* to enable electronic device 100 to wirelessly connect to, and transmit and receive voice and/or data communication to/from, one or more other devices, such as devices 152*a-n* and server 154. As a wireless device, device 100 can transmit data over a wireless network 150 (e.g., a Wi-Fi network, a cellular network, a Bluetooth® network (including Bluetooth® low energy (BLE) networks), a wireless ad hoc network (WANET), or a personal area network (PAN)). In one embodiment, electronic device 100 may be further equipped with an infrared (IR) device (not pictured) for communicating with other devices using an IR connection. In another embodiment, wireless radios 140*a-n* may include a short-range wireless device, including, but not limited to, a near field communication (NFC) device. In still another embodiment, electronic device 100 may communicate with one or more other device(s) using a wired or wireless USB connection.

Figure 2:
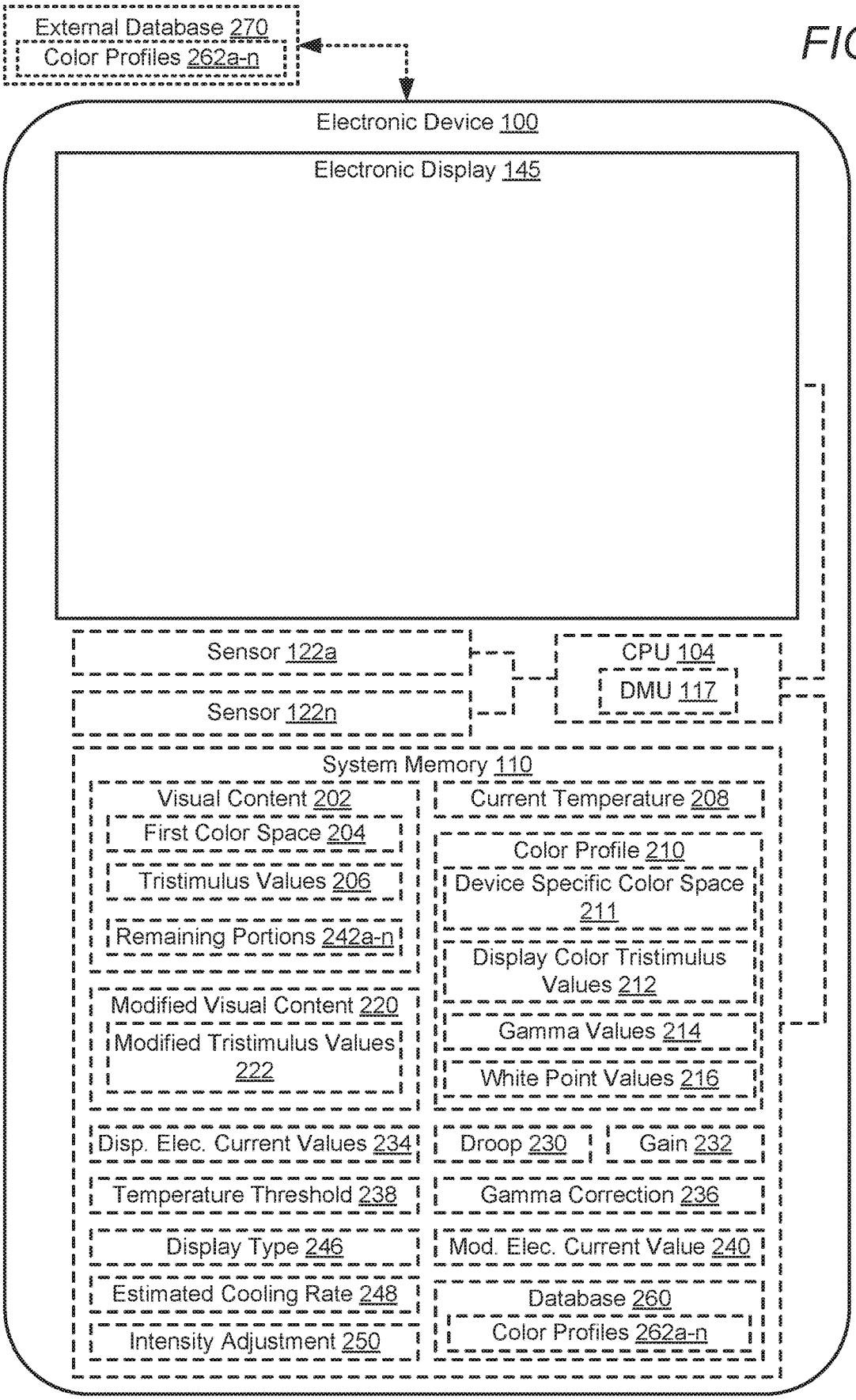
FIG. 2 illustrates an example electronic device, in accordance with one or more embodiments.

FIG. 2 is a block diagram illustrating additional functional components within example electronic device 100, in accordance with one or more embodiments of the present disclosure. As illustrated, electronic device 100 includes CPU 104, which executes DMU 117. Electronic device 100 also includes system memory 110, sensors 122*a-n*, and electronic display 145. Electronic display 145 is utilized to present visual content (e.g., images, video, and/or a user interface/GUI). In one embodiment, electronic device 100 is communicatively coupled to external database 270 having color profiles 262*a-n*.

Electronic device 100 identifies visual content 202 for rendering on electronic display 145. Visual content 202 includes tristimulus values 206, which are color values that define the color content within visual content 202. Tristimulus values 206 are encoded in first color space 204 in which the visual content 202 is encoded. In one embodiment, tristimulus values 206 are additive color values. In another embodiment, tristimulus values 206 are subtractive color values. Visual content 202 can also include gamma values (not illustrated) that define a luminance of the visual content and white point values (not illustrated) which define the color white for the visual content 202. In one embodiment, first color space 204 is the YCbCr color space, where Y is the brightness (luma), Cb is the blue difference chroma, and Cr is the red difference chroma. In other embodiments, first color space 204 may be a different color space. In one or more embodiments, visual content 202 is an input stream comprising a time varying content (e.g., a video stream).

In one or more embodiments, CPU 104 converts tristimulus values 206 of visual content 202 from first color space 204 to a linear color space (not illustrated), such as the Red Green Blue (RGB) color space. During this conversion, CPU 104 can also inverse/invert and/or undo gamma settings in the visual content 202. The resulting visual content 202 contains the tristimulus values 206 in a linear color space and white point values for the visual content 202.

CPU 104 identifies color profile 210 associated with electronic display 145. Color profile 210 specifies a device specific color space (e.g., device specific color space 211) for the electronic display 145 and defines display color tristimulus values 212, gamma values 214, and white point values 216 that are associated therewith. Display color tristimulus values 212 defines color tristimulus values for electronic display 145 that are expressed as a function of a temperature (current temperature 208) of electronic display 145. Persistent colors rendered by electronic display 145 are expressed as a function of display color tristimulus values 212 and may change as current temperature 208 rises or falls. Color profile 210 can also include gamma values 214 that define a luminance of electronic display 145 and white point values 216 which define the color white for the electronic display 145. In one embodiment, color profile 210 is stored within system memory 110 and/or preprogrammed within a firmware (e.g., firmware 112) of electronic device 100. In this embodiment, CPU 104 identifies color profile 210 by retrieving color profile 210 from memory.

In another embodiment, in identifying color profile 210, CPU 104 first determines a display type 246 associated with electronic display 145. To determine display type 246, CPU 104 may determine an identifier associated with electronic display 145, such as a serial number, model number, and/or part number. In another embodiment, CPU 104 determines display type 246 based on Extended Display Identification Data (EDID) stored within a memory of electronic display 145. In another embodiment, CPU 104 determines display type 246 based on identifying characteristics of electronic display specified with a driver software of electronic display 145. In another embodiment, CPU 104 determines display type 246 based on a color space associated with the display and/or at least one characteristic of electronic display 145, such as a display resolution, a display size, and/or the presence, arrangement, and/or number of one or more specific types of components (e.g., LEDs) in electronic display 145. In response to determining display type 246, CPU 104 accesses at least one database (e.g., database 260 and/or external database 270) having a plurality of color profiles (color profiles 262*a-n*), each of which is associated with a particular type of electronic display. In this embodiment, CPU 104 identifies a particular color profile (e.g., color profile 262*a*) from among color profiles 262*a-n* that matches display type 246. CPU 104 retrieves the particular color profile and stores the particular color profile within system memory 110 as color profile 210.

In one or more embodiments, current temperature 208 is a real-time temperature of at least one component of electronic display 145 that generates heat as a byproduct, such as a temperature of linear strip of LEDs, at least one lamp/light bulb, a plurality and/or multiplicity of LEDs. Current temperature 208 can include temperature readings for multiple components of electronic display 145. For example, current temperature 208 can include a temperature of all LEDs within electronic display 145. In another example, current temperature 208 can include a temperature at only select LEDs within electronic display 145. In another embodiment, current temperature 208 can be a peak temperature, median temperature, mode temperature, and/or average temperature of at least one component of electronic display 145 that generates heat as a byproduct. In another embodiment, current temperature 208 is a temperature at a particular surface of electronic display 145. In one embodiment, CPU 104 determines current temperature 208 of electronic display 145 by reading temperature values of at least one temperature sensor (e.g., sensor 122*a*) that is adjacent and/or proximate to electronic display 145 and/or at least one component of electronic display 145 that generates heat as a byproduct. In another embodiment, electronic display 145 may include at least one temperature sensor for measuring current temperature 208. In another embodiment, CPU 104 may estimate current temperature 208 based on thermal characteristics of electronic device 100. In one embodiment, thermal characteristics specify a current operating mode of one or more components (e.g., CPU 104) of electronic device 100 and/or an operating mode and/or speed of one or more cooling devices (e.g., cooling device 164) of electronic device 100. In still another embodiment, current temperature 208 is estimated based on temperature values read by at least one temperature sensor (e.g., sensor 122*n*) that is adjacent and/or proximate to other components of electronic device 100.

In response to determining current temperature 208, CPU 104 applies color profile 210 to visual content 202. By applying color profile 210 to visual content 202, CPU 104 converts visual content 202 from the linear color space to device specific color space 211. During this conversion, tristimulus values 206 are converted to modified tristimulus values 222 based on current temperature 208 and display color tristimulus values 212 (which are expressed as a function of current temperature 208). The conversion of tristimulus values 206 to modified tristimulus values 222 generates modified visual content 220, which includes modified tristimulus values 222. Modified tristimulus values 222 define the color content within visual content 202 as a function of current temperature 208. Thus, tristimulus values 206 of visual content 202 are adjusted to modified tristimulus values 222 in real-time based on current temperature 208 to provide modified visual content 220, which is rendered on electronic display 145. Each frame of modified visual content 220 that is rendered on electronic display 145 is true to the color content within tristimulus values 206 of visual content 202 as current temperature 208 changes. In one embodiment, modified tristimulus values 222 encoded in device specific color space 211 can be displayed by electronic display 145. In another embodiment, after generating modified visual content 220 (which includes modified tristimulus values 222), CPU 104 converts modified tristimulus values 222 to a standard color space (e.g., the RGB color space) that may be displayed by electronic display 145.

CPU 104 renders modified visual content 220 on electronic display 145. Tristimulus values 206 of visual content 202 are adjusted in real-time to modified tristimulus values 222. The adjustments, which are based on current temperature 208, provide modified visual content 220, which is rendered on electronic display 145 in real-time. Thus, modified visual content 220 on electronic display 145 provides an authentic reproduction of visual content 202. In one or more embodiments, gamma settings from visual content 202 are reapplied to the modified visual content 220 prior to rendering modified visual content 220 on electronic display 145.

Electronic display 145 is driven by display electrical current. The display electrical current is a supplied electrical drive current that determines a spectral intensity and total luminosity of electronic display 145. In one or more embodiments, CPU 104 monitors the display electrical current and stores, in system memory 110, display electrical current values 234 which identify a level of real-time current being provided to electronic display 145. In one or more embodiments, as a display electrical current rises, electronic display 145 can experience a droop (e.g., droop 230), which is a non-linear loss in color output intensity of electronic display 145 and/or an increase in luminous flux of electronic display 145 relative to a corresponding rise in the display electrical current (as measured by display electrical current values 234). That is, droop 230 represents a decrease in luminous efficiency of electronic display 145 as display electrical current rises. In one embodiment, CPU 104 measures a luminous intensity of electronic display 145 by a light sensor that is coupled to electronic device 100 during rendering of modified visual content 220. The measured luminous intensity is then compared with an expected luminous intensity to determine droop 230. In another embodiment, droop 230 may be determined based on known specifications for electronic display 145. For example, CPU 104 can determine droop 230 for electronic display 145 based on a current value of display electrical current values 234.

CPU 104 can further adjust the spectral intensity and total luminosity of modified visual content 220 in order to compensate for droop 230 and ensure an authentic reproduction of visual content 202. In one embodiment, in response to determining droop 230, CPU 104 calculates, based on color profile 210, gain 232 to apply to modified tristimulus values 222 that compensates for droop 230 and ensures that the luminous intensity of electronic display 145 during rendering of modified visual content 220 on electronic display 145 matches an expected luminous intensity. Gain 232 is an output ratio that represents an increase or decrease in luminance intensity. In response to calculating gain 232, CPU 104 applies gain 232 to modified tristimulus values 222 of modified visual content 220 and renders modified visual content 220, with the applied gain 232, on electronic display 145.

In another embodiment, in response to determining droop 230, CPU 104 calculates, based on color profile 210, gamma correction 236, which compensates for droop 230. Gamma correction 236 is a brightness correction that represents an increase or decrease in overall brightness of visual content. Gamma correction 236 maintains an overall brightness of modified visual content 220 during rendering of modified visual content 220 on electronic display 145 to an expected overall brightness associated with visual content 202. In response to calculating gamma correction 236, CPU 104 applies gamma correction 236 to modified visual content 220. CPU 104 renders the modified visual content 220 on electronic display 145.

Electronic display 145 may also generate heat. Temperatures over temperature threshold 238 may risk damage and/or shorten the expected operational life of electronic display 145 and/or other components of electronic device 100. In one or more embodiments, temperature threshold 238 is a preset value, such as a temperature value established by a manufacturer. In one or more embodiments, CPU 104 determines whether current temperature 208 meets and/or exceeds temperature threshold 238. In response to determining that current temperature 208 meets and/or exceeds temperature threshold 238, CPU 104 accesses color profile 210. CPU 104 determines at least one modified electrical current value 240 that will reduce current temperature 208 to a temperature that does not exceed temperature threshold 238. Modified electrical current value 240 defines an electrical current level that assists in mitigating negative effects caused by heat generated by electronic display 145 and which also ensures that modified visual content 220 provides a content reproduction that closely matches visual content 202 when modified visual content 220 is rendered by electronic display 145. In response to determining modified electrical current value 240, CPU 104 applies a corresponding level of electrical current to electronic display 145. In one or more embodiments, CPU 104 can adjust the display electrical current of electronic display 145 to a level corresponding to modified electrical current value 240 without interruption to modified visual content 220 that is already being rendered on electronic display 145.

In an embodiment where visual content 202 comprises time varying content, CPU 104 may perform a luminous analysis on at least one remaining portion 242*a-n* of visual content 202 to determine a degree of luminous content for each of the remaining portions 242*a-n*. CPU 104 further determines estimated cooling rate 248 of electronic device 100. Estimated cooling rate 248 establishes an anticipated rate in which heat may be dissipated by electronic display 145 and/or electronic device 100 as a whole. In one embodiment, estimated cooling rate 248 is a preset value/rate. In another embodiment, estimated cooling rate 248 is determined, in part, based on at least one of: current temperature 208, cooling devices 164*a-n* present in electronic device 100, an operational mode of any active cooling devices from among cooling devices 164*a-n*, a current profile associated with TMU 119, and/or future scheduled cooling settings associated with TMU 119. In response to determining estimated cooling rate 248, CPU 104 calculates intensity adjustment 250. Intensity adjustment 250 establishes new settings for at least one or more of modified tristimulus values 222, gain 232, and/or gamma correction 236, based on the luminous content in remaining portions 242*a-n*, current temperature 208, and color profile 210. Intensity adjustment 250 maintains a consistent intensity level of modified visual content 220 on electronic display 145 for the entirety of remaining portions 242*a-n*. In one embodiment, intensity adjustment 250 provides at least one of an increase in a luminosity level and a decrease in a luminosity level of remaining portions 242*a-n*. CPU 104 applies intensity adjustment 250 to modified visual content 220 for the duration of remaining portions 242*a-n*.

In another embodiment, CPU 104 performs a luminous analysis on remaining portions 242*a-n* of visual content 202 to determine whether there exists both (i) at least one darker future portion (e.g., portion 242*a*) of the visual content 202 having a later visual content that has a darker luminosity from a current visual content of visual content 202 and (ii) at least one lighter future portion (e.g., portion 242*n*) of visual content 202 having a later visual content that has a lighter luminosity from a current visual content of visual content 202. In one or more embodiments, electronic display 145 may consume more energy and/or generate more heat during lighter future portions. In order to conserve energy and reduce heat generated by electronic device 100 during those lighter future portions, CPU 104 pre-calculates modified tristimulus values 222 for frames corresponding to frames within lighter future portions during those darker future portions of visual content 202. In response to input stream 202 reaching at least one lighter future portion that is associated with frames that were precalculated, CPU 104 renders those plurality of frames of at least one lighter future portion on electronic display 145 using the precalculated modified tristimulus values.

Figure 3:
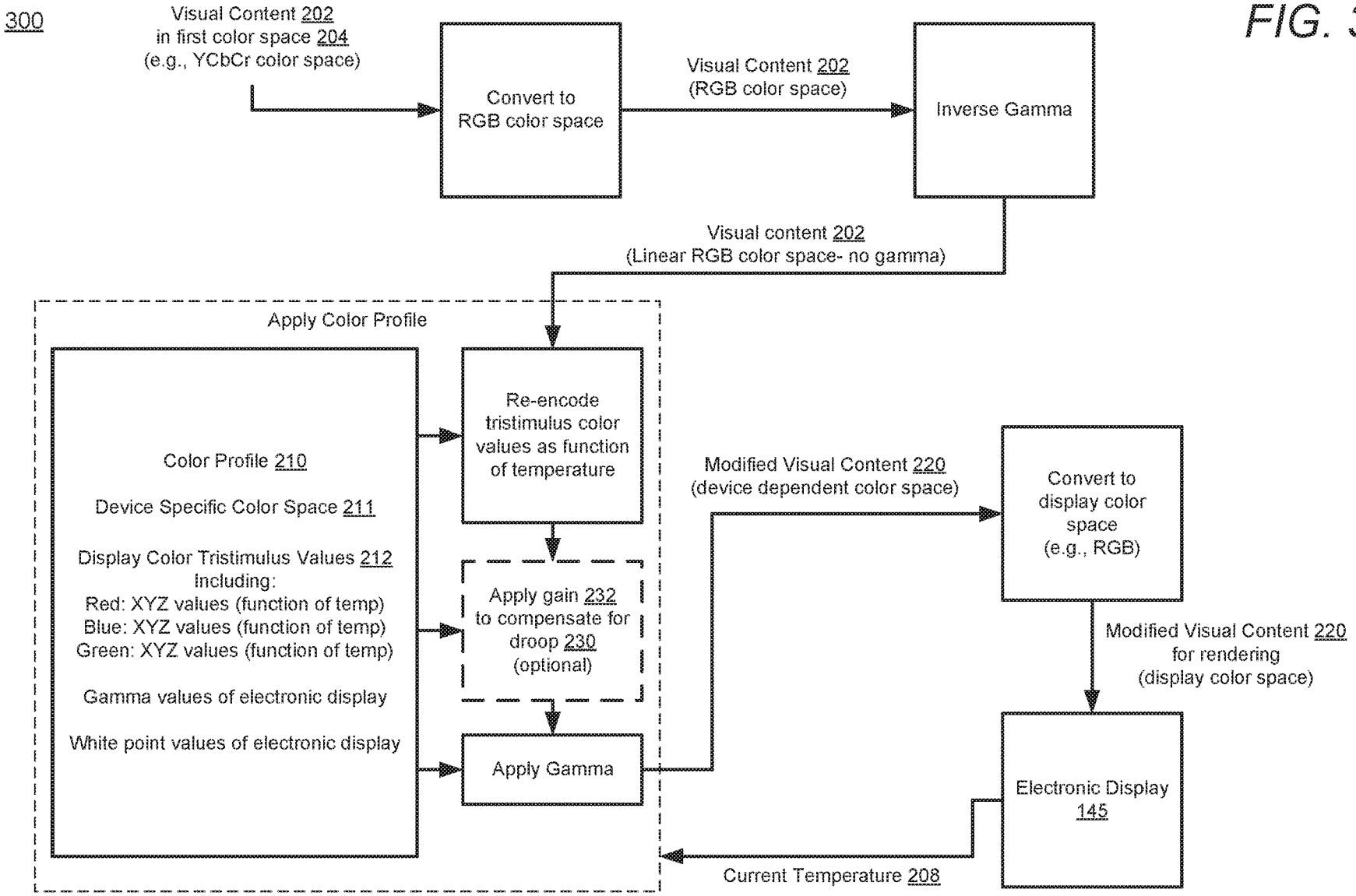
FIG. 3 illustrates a flow of visual content for rendering on an electronic display, in accordance with one embodiment of the present disclosure.

Referring now to FIG. 3, there is depicted a diagram illustrating a flow of visual content for rendering on electronic display, in accordance with one embodiment of the present disclosure. Electronic device 100 identifies visual content 202, which is encoded in first color space 204 (e.g., the YCbCr color space). CPU 104 converts visual content 202 into a device color space (e.g., RGB color space). CPU 104 then inverses the gamma settings in visual content 202 which converts visual content from the device color space (e.g., RGB color space) into a linear device color space (e.g., Linear RGB color space). CPU 104 then identifies color profile 202 associated with electronic display 145 and applies color profile 202 to visual content 202 (which is encoded in the RGB color space and has gamma removed). During application of color profile 210 to visual content 202, CPU 104 re-encodes tristimulus color values 206 of visual content 202 to generate modified visual content 220 having modified color tristimulus values 222. The re-encoding of the tristimulus color values is based on display color tristimulus values 212 and white point values 214 within color profile 210 and current temperature 208 of electronic display 210. CPU 104 may optionally apply gain 232 to modified visual content 220 to compensate for droop 230 of electronic display 210. CPU 104 also reapplies gamma to modified visual content 220 based on gamma in visual content 202 and gamma values 214 within color profile 210. In one or more embodiments, modified visual content 220 is converted into a standard color space (e.g., RGB) associated with electronic display 145. Modified visual content 220 is then rendered and presented on electronic display 145.

Referring now to FIGS. 4-9, aspects of the methods are described with reference to the components of FIGS. 1-3. Several of the processes of the methods provided in FIGS. 4-9 can be implemented by a processor (e.g., CPU 104) executing software code (i.e., program instructions) of DMU 117 within a device (e.g., electronic device 100). The method processes described in FIGS. 4-9 are generally described as being performed by components of electronic device 100.

Figure 4:
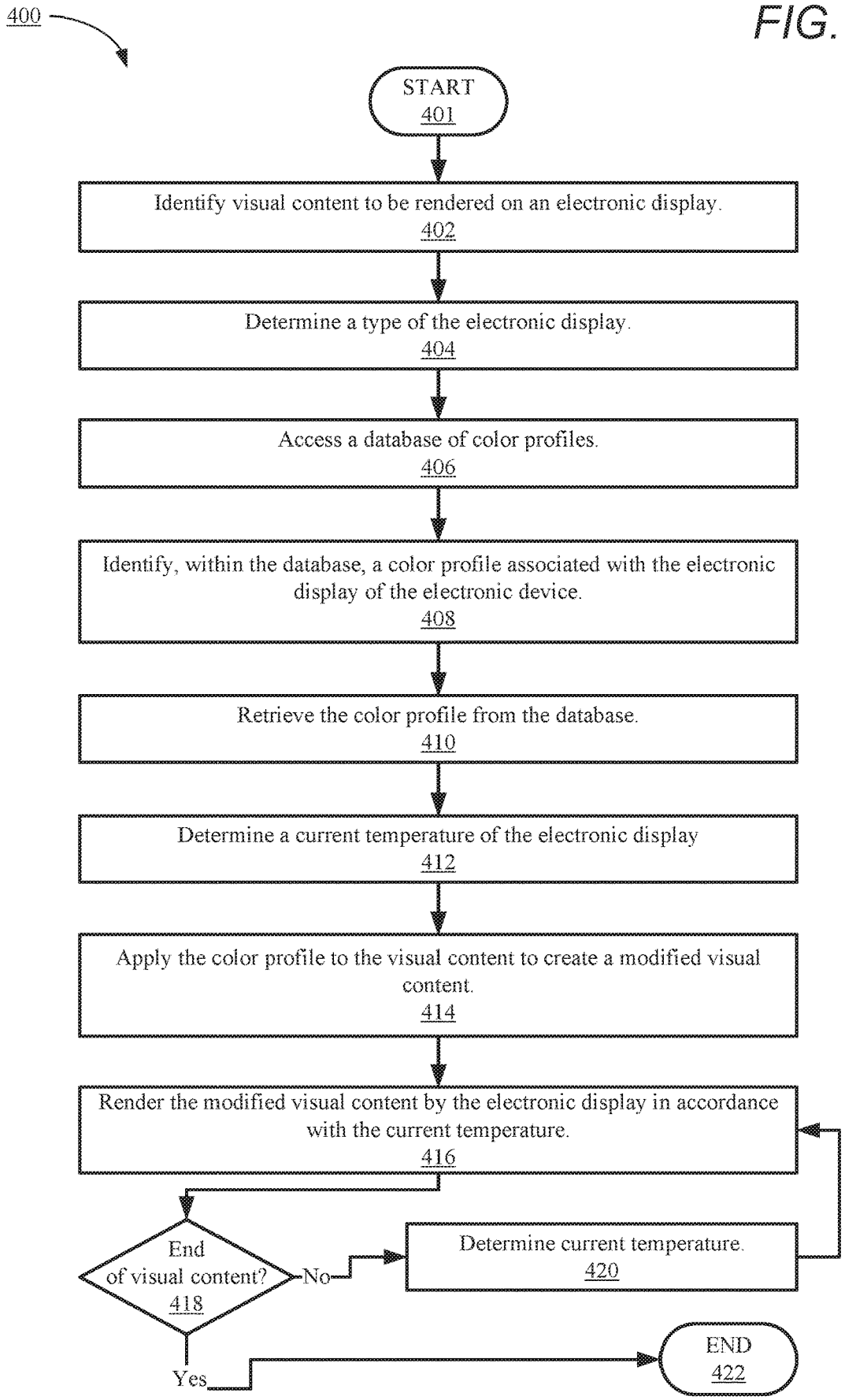
FIG. 4 is a flow chart illustrating a method for managing image quality of an electronic display, in accordance with one or more embodiments.

Referring now to FIG. 4, there is depicted a flow chart illustrating a method for managing image quality of an electronic display, in accordance with one or more embodiments of the present disclosure. Method 400 commences at initiator block 401 then proceeds to block 402. At block 402, visual content (e.g., visual content 202) to be rendered on electronic display 145 is identified by CPU 104. The visual content may be requested by a user of electronic device 100 and/or an application (e.g., applications 118) executing on electronic device 100. In another embodiment, the visual content may be received from another device (e.g., device 152*a-n* and/or server 154). At block 404, CPU 104 determines a display type (e.g., display type 246) associated with the electronic display. At block 406, CPU 104 accesses at least one database (e.g., database 260 and/or external database 270) having a plurality of color profiles (e.g., color profiles 262*a-n*), each of which is associated with a particular type of electronic display. At block 408, CPU 104 determines, from among the plurality of color profiles in the at least one database, a color profile (e.g., color profile 210) that is associated with the electronic display and/or, which matches the display type of the electronic display and which has color tristimulus values for the electronic display that are expressed as a function of temperature. At block 410, CPU 104 retrieves the color profile from the at least one database. At block 412, CPU 104 determines the current temperature (e.g., current temperature 208) of the electronic display. In one embodiment, the current temperature is measured by at least one sensor (e.g., sensor 122*a*) that is proximate to and/or embedded within the electronic display. In another embodiment, CPU 104 estimates the current temperature based on a current operating mode and/or thermal characteristics of the electronic device and/or components therein. At block 414, CPU 104 applies the color profile to the visual content to create a modified visual content (e.g., modified visual content 220) having color tristimulus values that are expressed as a function of temperature of the electronic display. At block 416, CPU 104 renders the modified visual content on the electronic display in real-time in accordance with the current temperature. At decision block 418, CPU 104 determines whether the end of the visual content has been reached. In response to determining the end of the visual content has not been reached, CPU 104 determines the current temperature (e.g., current temperature 208) of the electronic display (block 420), and method 400 continues to block 416 where the modified visual content is rendered on the electronic display in real-time in accordance with the current temperature. In response to determining the end of the visual content has been reached, method 400 ends at block 422.

Figure 5:
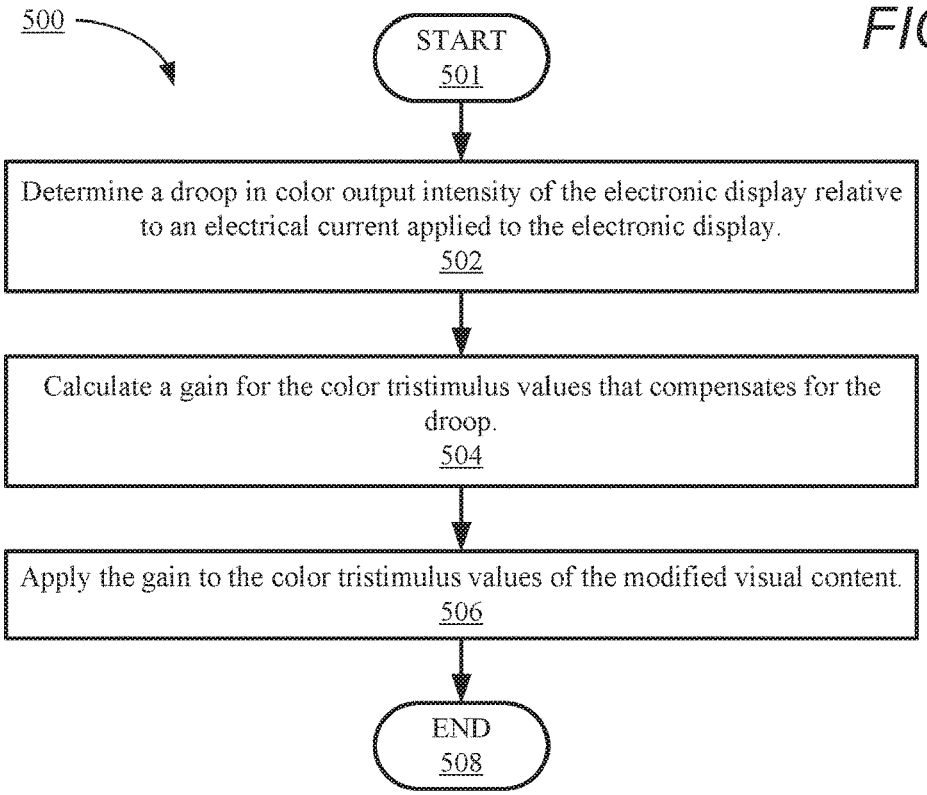
FIG. 5 is a flow chart illustrating a method for compensating for a droop in color output intensity by adjusting a gain applied to visual content, in accordance with one or more embodiments.

Referring now to FIG. 5, there is depicted a flow chart illustrating a method for compensating for a droop in color output intensity by adjusting a gain applied to visual content, in accordance with one or more embodiments of the present disclosure. Method 500 commences at initiator block 501 then proceeds to block 502. At block 502, CPU 104 determines a droop (e.g., droop 230) in color output intensity of the electronic display (e.g., electronic display 145) relative to a level of electrical current being applied to the electronic display (block 502). At block 504, CPU 104 calculates a gain (e.g., gain 232) for the color tristimulus values (e.g., modified color tristimulus values 222) of the modified visual content (modified visual content 220) to be rendered on the electronic display. At block 506, CPU 104 applies the gain to the color tristimulus values of the modified visual content 220. Method 500 ends at block 508.

Figure 6:
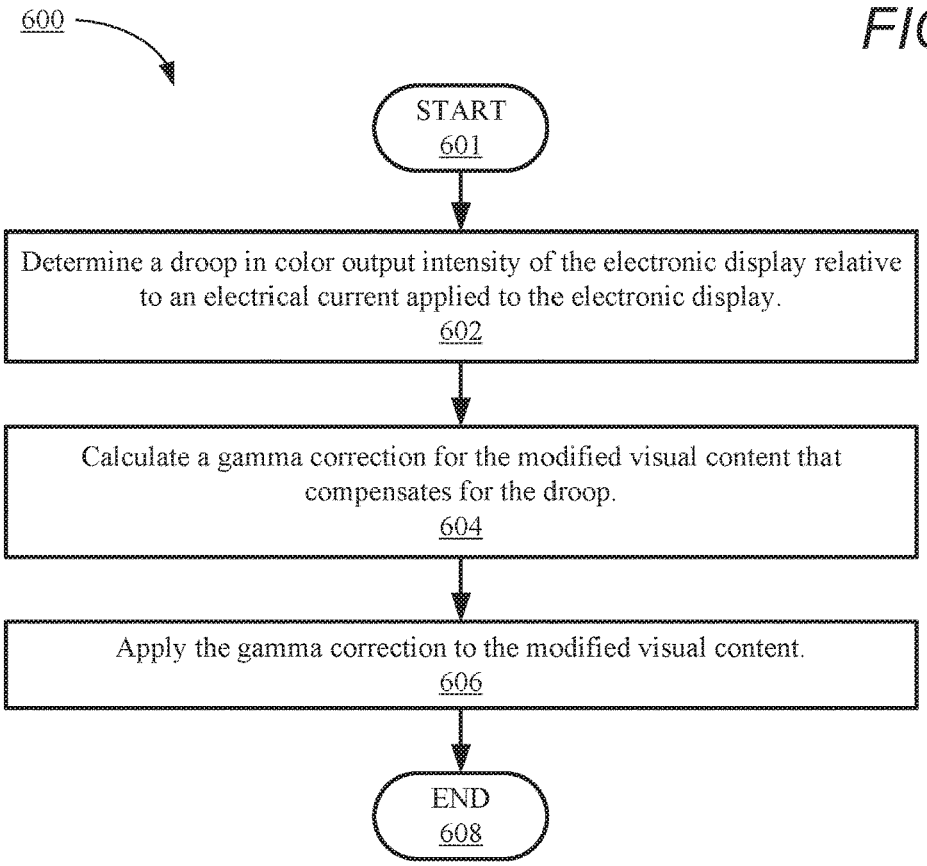
FIG. 6 is a flow chart illustrating a method for compensating for a droop in color output intensity by correcting gamma of a visual content, in accordance with one or more embodiments.

Referring now to FIG. 6, there is depicted a flow chart illustrating a method for compensating for a droop in color output intensity by correcting gamma of a visual content, in accordance with one or more embodiments of the present disclosure. Method 600 commences at initiator block 601, then proceeds to block 602. At block 602, CPU 104 determines a droop (e.g., droop 230) in color output intensity of the electronic display (e.g., electronic display 145) relative to an electrical current (e.g., display electrical current 234) applied to the electronic display. At block 604, CPU 104 calculates a gamma correction (e.g., gamma correction 234) for the modified visual content (modified visual content 220). At block 606, CPU 104 applies the gamma correction to the modified visual content and renders the modified visual content with the gamma correction on the electronic display. Method 600 ends at block 608.

Figure 7:
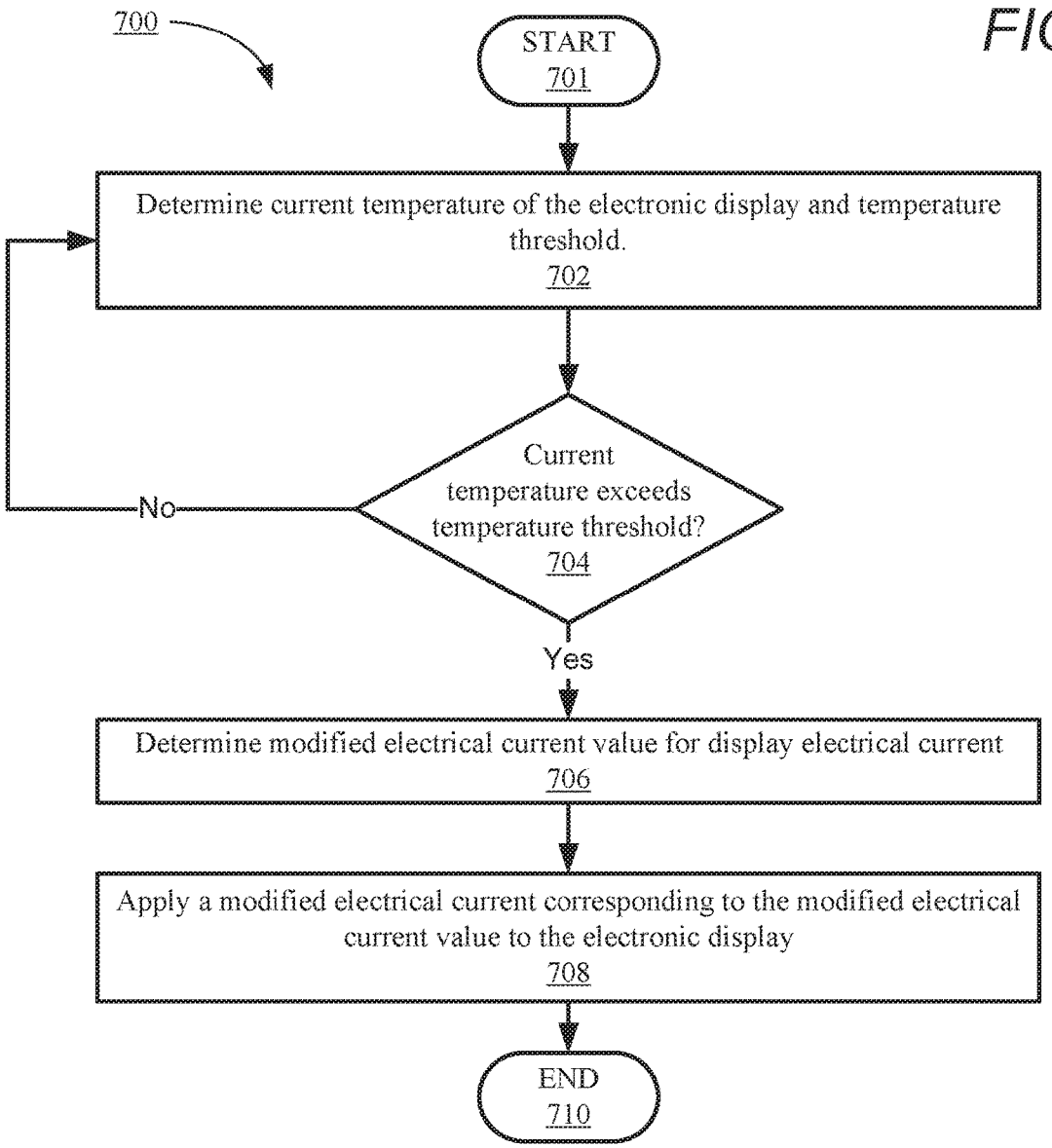
FIG. 7 is a flow chart illustrating a method for managing image quality of an electronic display based on a current temperature of an electronic display, in accordance with one or more embodiments.

Referring now to FIG. 7, there is depicted a flow chart illustrating a method for managing image quality of an electronic display based on a current temperature of an electronic display, in accordance with one or more embodiments. Method 700 commences at initiator block 701 then proceeds to block 702. At block 702, CPU 104 determines the current temperature (e.g., current temperature 208) of an electronic display (e.g., electronic display 145) of electronic device 100. At decision block 704, CPU 104 determines whether the current temperature has exceeded a predetermined temperature threshold (e.g., temperature threshold 238). In response to determining current temperature has not exceeded a predetermined temperature threshold, method 700 returns to block 702. In response to determining current temperature has exceeded a predetermined temperature threshold, method 700 continues to block 706. At block 706, CPU 104 determines a modified electrical current value (e.g., modified electrical current value 240) to apply to the electronic display that will reduce the current temperature to a temperature that does not exceed the temperature threshold. In another embodiment, the modified electrical current mitigates negative effects caused by heat generated by electronic display and/or ensures that the modified visual content when rendered by electronic display provides a content reproduction that closely matches an original visual content (e.g., visual content 202). At block 708, CPU 104 applies the modified electrical current to the electronic display. Method 700 then ends at block 710.

Figure 8:
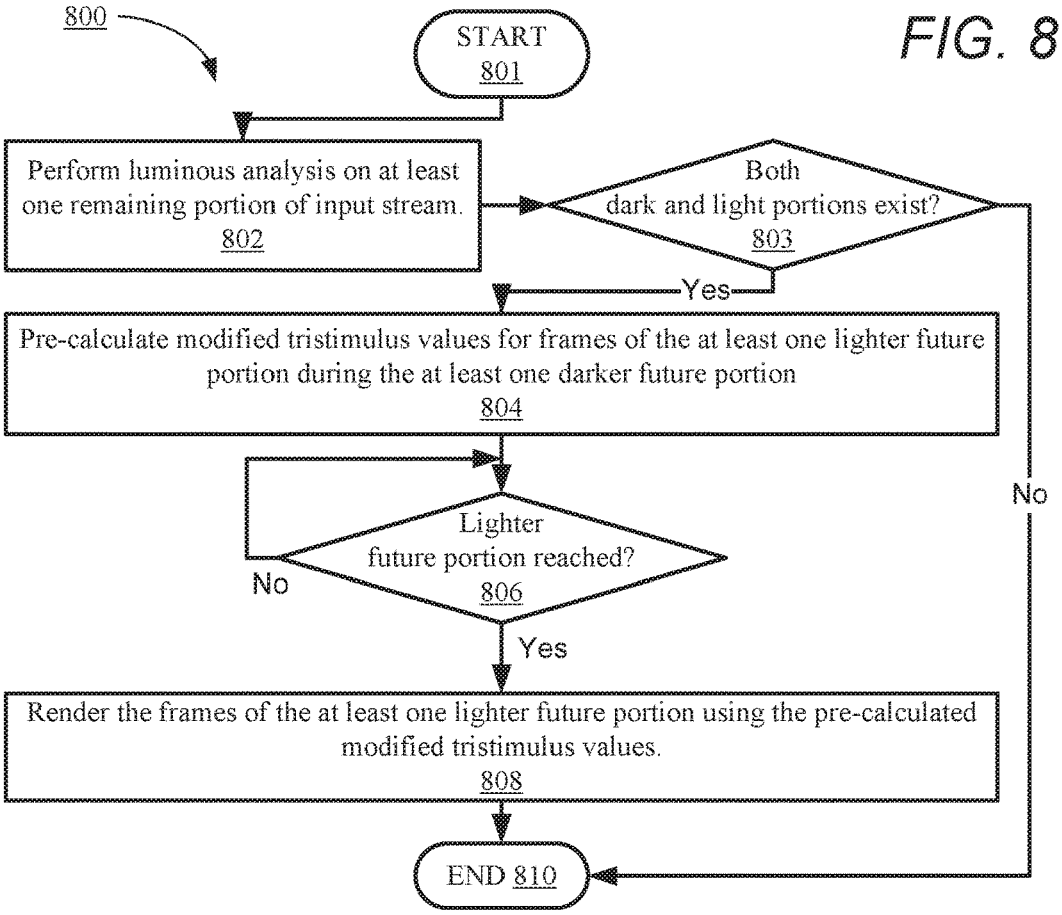
FIG. 8 is a flow chart illustrating a method for precalculating a color profile for portions of an input stream, in accordance with one or more embodiments.

Referring now to FIG. 8, there is depicted a flow chart illustrating a method for pre-calculating a color profile for remaining portions of an input stream, in accordance with one or more embodiments. Method 800 commences at initiator block 801 then proceeds to block 802. At block 802, CPU 104 performs a luminous analysis on a remaining portion of a visual content comprising an input stream. At block 803, CPU 104 determines, based on the luminous analysis, whether there exists at least one darker future portion (e.g., portion 242*a*) and at least one lighter future portion (e.g., portion 242*n*). The at least one darker future portion is a later visual content within the visual content that has a darker luminosity from a current visual content of visual content. The at least one lighter future portion is a later visual content within the visual content that has a lighter luminosity from a current visual content of visual content. In response to determining both dark and light portions do not exist, method 800 terminates at block 810. In response to determining both dark and light portions exist, method 800 continues to block 804. At block 804, CPU 104 pre-calculates modified tristimulus values 222 for frames corresponding to frames within lighter future portions during those darker future portions of visual content 202. At decision block 806, CPU 104 determines whether the at least one lighter future portion of the visual content input stream has been reached. In response to the visual content input stream reaching the at least one lighter future portion, CPU 104 renders the frames of the at least one lighter future portion on electronic display 145 using the precalculated modified tristimulus values (block 808). Method 800 then ends at block 810.

Figure 9:
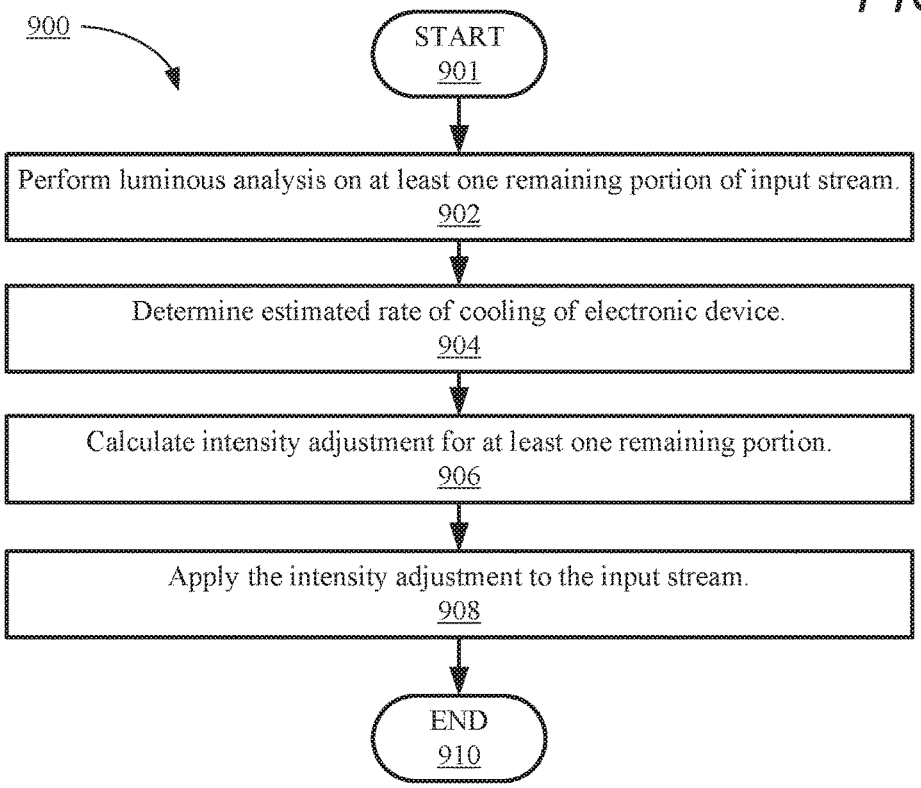
FIG. 9 is a flow chart illustrating a method for adjusting an intensity of an input stream based on an estimated rate of cooling of an electronic device, in accordance with one or more embodiments.

Referring now to FIG. 9, there is depicted a flow chart illustrating a method for adjusting an intensity of an input stream based on an estimated rate of cooling of an electronic device, in accordance with one or more embodiments. Method 900 commences at initiator block 901 then proceeds to block 902. At block 902, CPU 104 performs a luminous analysis on at least one remaining portion (e.g., remaining portions 242*a-n*) of a visual content (e.g., visual content 202) to determine a degree of luminous content for each remaining portion. At block 904, CPU 104 further determines an estimated cooling rate (e.g., estimated cooling rate 248) of electronic device 100. In response to determining estimated cooling rate 248, CPU 104 calculates an intensity adjustment (e.g., intensity adjustment 250) for the at least one remaining portion (block 906). At block 908, CPU 104 applies the intensity adjustment to the modified visual content (e.g., modified visual content 220) for the duration of remaining portions. Method 900 then ends at block 910.

In the above-described flow charts of FIG. 4-9, one or more of the method processes may be embodied in a computer readable device containing computer readable code such that a series of steps are performed when the computer readable code is executed on a computing device. In some implementations, certain steps of the methods are combined, performed simultaneously or in a different order, or perhaps omitted, without deviating from the scope of the disclosure. Thus, while the method steps are described and illustrated in a particular sequence, use of a specific sequence of steps is not meant to imply any limitations on the disclosure. Changes may be made with regards to the sequence of steps without departing from the spirit or scope of the present disclosure. Use of a particular sequence is therefore, not to be taken in a limiting sense, and the scope of the present disclosure is defined only by the appended claims.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. Computer program code for carrying out operations for aspects of the present disclosure may be written in any combination of one or more programming languages, including an object-oriented programming language, without limitation. These computer program instructions may be provided to a processor of a general-purpose computer, special-purpose computer, or other programmable data processing apparatus to produce a machine that performs the method for implementing the functions/acts specified in the flowchart and/or block diagram block or blocks. The methods are implemented when the instructions are executed via the processor of the computer or other programmable data processing apparatus.

As will be further appreciated, the processes in embodiments of the present disclosure may be implemented using any combination of software, firmware, or hardware. Accordingly, aspects of the present disclosure may take the form of an entirely hardware embodiment or an embodiment combining software (including firmware, resident software, micro-code, etc.) and hardware aspects that may all generally be referred to herein as a "circuit," "module," or "system." Furthermore, aspects of the present disclosure may take the form of a computer program product embodied in one or more computer readable storage device(s) having computer readable program code embodied thereon. Any combination of one or more computer readable storage device(s) may be utilized. The computer readable storage device may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage device can include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage device may be any tangible medium that can contain, or store a program for use by or in connection with an instruction execution system, apparatus, or device.

Where utilized herein, the terms "tangible" and "non-transitory" are intended to describe a computer-readable storage medium (or "memory") excluding propagating electromagnetic signals; but are not intended to otherwise limit the type of physical computer-readable storage device that is encompassed by the phrase "computer-readable medium" or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

While the disclosure has been described with reference to example embodiments, it will be understood by those skilled in the art that various changes may be made and equivalents may be substituted for elements thereof without departing from the scope of the disclosure. In addition, many modifications may be made to adapt a particular system, device, or component thereof to the teachings of the disclosure without departing from the scope thereof. Therefore, it is intended that the disclosure not be limited to the particular embodiments disclosed for carrying out this disclosure, but that the disclosure will include all embodiments falling within the scope of the appended claims.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A method comprising:

identifying a visual content to be rendered on an electronic display associated with an electronic device, wherein the visual content is encoded in a first color space;

identifying a color profile associated with the electronic display, wherein the color profile specifies color tristimulus values for the electronic display that are expressed as a function of temperature;

determining a current temperature of the electronic display;

determining a droop in a color output intensity of the electronic display relative to an electrical current applied to the electronic display;

calculating, based on the color profile, at least one of a gain for the color tristimulus values and a gamma correction that compensates for the droop;

applying the color profile to the visual content to create a modified visual content for rendering by the electronic display, wherein the color profile corrects tristimulus values of the visual content to ensure color content in the modified visual content that is rendered by the electronic display is true to color content in the visual content;

applying a corresponding one of the gain to the color tristimulus values and the gamma correction of the modified visual content; and rendering the modified visual content by the electronic display, wherein during rendering of the visual content by the display, the color tristimulus values of the visual content are adjusted in real-time based on the current temperature to provide the modified visual content.

2. The method of claim 1, wherein the color profile further comprises at least one of: gamma values and white point values for the electronic display.

3. The method of claim 1, wherein:

the calculating comprises calculating, based on the color profile, the gain for the color tristimulus values that compensates for the droop; and the applying comprises applying the gain to the color tristimulus values of the modified visual content.

4. The method of claim 1, wherein:

the calculating comprises calculating, based on the color profile, the gamma correction that compensates for the droop; and the applying comprises applying the gamma correction to the modified visual content.

5. A method comprising:

identifying a visual content to be rendered on an electronic display that is coupled to an electronic device, wherein the visual content is encoded in a first color space;

determining a current temperature of the electronic display;

identifying a color profile associated with the electronic display, wherein the color profile specifies color tristimulus values for the electronic display that are expressed as a function of temperature;

applying the color profile to the visual content to create a modified visual content for rendering by the electronic display, wherein the color profile corrects tristimulus values of the visual content to ensure color content in the modified visual content that is rendered by the electronic display is true to color content in the visual content;

determining whether the current temperature of the electronic display has exceeded at least one temperature threshold;

in response to determining that the current temperature has exceeded at least one temperature threshold, determining, based on the color profile, a modified electrical current to be applied to the electronic display that will reduce the current temperature to a temperature that does not exceed the at least one temperature threshold and which ensures the color content in the modified visual content is representative of the color content in the visual content;

applying the modified electrical current to the electronic display; and rendering the modified visual content by the electronic display, wherein during rendering of the visual content by the display, the color tristimulus values of the visual content are adjusted in real-time based on the current temperature to provide the modified visual content.

6. The method of claim 1, wherein the visual content is an input stream comprising a time varying content, the method further comprising:

performing a luminous analysis on at least one remaining portion of the input stream to identify: at least one lighter future portion of the input stream having a later visual content that has a lighter luminosity from a current visual content of the input stream; and at least one darker future portion having a later visual content that has a darker luminosity from a current visual content;

in response to identifying the at least one darker future portion visual content and the at least one lighter future portion, pre-calculating, during the at least one darker future portion, a plurality of modified tristimulus values for each of a plurality of frames of the modified visual content within the at least one lighter future portion based on a combination of the current temperature, a time remaining until the input stream reaches the at least one lighter future portion, and the visual content during the at least one lighter future portion; and in response to the input stream reaching the at least one future portion, rendering the plurality of frames using the pre-calculated modified tristimulus values.

7. The method of claim 1, wherein the visual content is an input stream comprising a time varying content, and wherein applying the color profile to the visual content further comprises:

performing a luminous analysis on at least one remaining portion of the input stream;

determining an estimated rate of cooling of the electronic device;

calculating an intensity adjustment for the at least one remaining portion of the input stream based on the luminous content, the estimated rate of cooling, and the current temperature, wherein the intensity adjustment establishes for the at least one remaining portion provides at least one of: an increase in luminosity level and a decrease in luminosity level; and applying the intensity adjustment to the input stream, wherein the intensity adjustment is applied for the duration of the at least one remaining portion.

8. The method of claim 1, wherein identifying the color profile further comprises:

determining a type of the electronic display;

accessing a database comprising an association of each of a plurality of electronic display types with at least one of a plurality of color profiles, wherein each of the plurality of color profiles is associated with a particular type of electronic display; and retrieving, from the database, a particular color profile that matches the type of the electronic display, wherein the particular color profile is the color profile.

9. An electronic device comprising:

an electronic display;

at least one temperature sensor that measures a temperature of the electronic display;

a memory comprising a visual content to be rendered on the electronic display, wherein the visual content is encoded in a first color space;

at least one processor that:

identifies a color profile associated with the electronic display, wherein the color profile specifies color tristimulus values for the electronic display that are expressed as a function of temperature;

determines a droop in a color output intensity of the electronic display relative to an electrical current applied to the electronic display;

calculates, based on the color profile, at least one of a gain for the color tristimulus values and a gamma correction that compensates for the droop;

applies the color profile to the visual content to create a modified visual content for rendering by the electronic display, wherein the color profile corrects tristimulus values of the visual content to ensure color content in the modified visual content that is rendered by the electronic display is true to color content in the visual content;

applies a corresponding one of the gain to the color tristimulus values and the gamma correction of the modified visual content; and renders the modified visual content by the electronic display, wherein during rendering of the visual content by the electronic display, the color tristimulus values of the visual content are adjusted in real-time based on the current temperature to provide the modified visual content.

10. The electronic device of claim 9, wherein the color profile also specifies at least one of: gamma values and white point values for the electronic display.

11. The electronic device of claim 9, wherein:

in calculating at least one of the gain and the gamma correction, the at least one processor calculates, based on the color profile, the gain for the color tristimulus values that compensates for the droop; and in applying the corresponding one of the gain and the gamma correction, the at least one processor applies the gain to the color tristimulus values of the modified visual content.

12. The electronic device of claim 9, wherein:

in calculating at least one of the gain and the gamma correction, the at least one processor:

calculates, based on the color profile, the gamma correction that compensates for the droop; and in applying the corresponding one of the gain and the gamma correction, the at least one processor applies the gamma correction to the modified visual content.

13. The electronic device of claim 9, wherein the at least one processor:

determines whether the temperature has exceeded at least one temperature threshold;

in response to determining that the temperature of the electronic display has exceeded at least one temperature threshold, determines, based on the color profile, a modified electrical current to be applied to the electronic display that will reduce the current temperature to a temperature that does not exceed the at least one temperature threshold and which ensures the color content in the modified visual content is representative of the color content in the visual content; and applies the modified electrical current to the electronic display.

14. The electronic device of claim 9, wherein the visual content is an input stream comprising a time varying content, and wherein the at least one processor:

performs a luminous analysis on at least one remaining portion of the input stream to identify:

at least one lighter future portion of the input stream having a later visual content that has a lighter luminosity from a current visual content of the input stream; and at least one darker future portion having a later visual content that has a darker luminosity from a current visual content;

in response to identifying the at least one darker future portion visual content and the at least one lighter future portion, pre-calculates, during the at least one darker future portion, a plurality of modified tristimulus values for each of a plurality of frames of the modified visual content within the at least one lighter future portion based on a combination of the current temperature, a time remaining until the input stream reaches the at least one lighter future portion, and the visual content during the at least one lighter future portion; and in response to the input stream reaching the at least one future portion, renders the plurality of frames using the precalculated modified tristimulus values.

15. The electronic device of claim 9, wherein the visual content is an input stream comprising a time varying content, and wherein in applying the color profile to the visual content the at least one processor:

performs a luminous analysis on at least one remaining portion of the input stream;

determines an estimated rate of cooling of the electronic device;

calculates an intensity adjustment for the at least one remaining portion of the input stream based on the luminous content, the estimated rate of cooling, and the current temperature, wherein the intensity adjustment establishes for the at least one remaining portion at least one of: an increase in luminosity level and a decrease in luminosity level; and applies the intensity adjustment to the input stream, wherein the intensity adjustment is applied for the duration of the at least one remaining portion.

16. The electronic device of claim 9, wherein, in determining the color profile, the at least one processor:

determines a type of the electronic display;

accesses a database comprising an association of each of a plurality of electronic display types with at least one of a plurality of color profiles, wherein each of the plurality of color profiles is associated with a particular type of electronic display; and retrieves, from the database, a particular color profile that matches the type of the electronic display, wherein the particular color profile is the color profile.

17. A computer program product comprising:

a non-transitory computer readable storage device; and program code on the computer readable storage device that, when executed by a processor associated with an electronic device, enables the electronic device to provide the functionality of:

identifying a visual content to be rendered by an electronic display that is coupled to the electronic device, wherein the visual content is encoded in a first color space;

identifying a color profile associated with the electronic display, wherein the color profile specifies color tristimulus values for the electronic display that are expressed as a function of temperature;

determining a current temperature of the electronic display;

determining a droop in a color output intensity of the electronic display relative to an electrical current applied to the electronic display;

calculating, based on the color profile, at least one of a gain for the color tristimulus values and a gamma correction that compensates for the droop;

applying the color profile to the visual content to create a modified visual content for presentation on the electronic display, wherein the color profile corrects tristimulus values of the visual content to ensure color content in the modified visual content that is rendered by the electronic display is true to color content in the visual content;

applying a corresponding one of the gain to the color tristimulus values and the gamma correction of the modified visual content; and presenting the modified visual content on the electronic display, wherein during presentation of the visual content on the electronic display, the color tristimulus values of the visual content are adjusted in real-time based on the current temperature to provide the modified visual content.

18. The computer program product of claim 17, wherein:

the program code for calculating comprises code for calculating, based on the color profile, a gain for the color tristimulus values that compensates for the droop; and the program code for applying comprises code for applying the gain to the color tristimulus values of the modified visual content.

19. The computer program product of claim 17, wherein the visual content is an input stream comprising a time varying content, and the program code for applying the color profile to the visual content further comprises code for:

performing a luminous analysis on at least one remaining portion of the input stream;

determining an estimated rate of cooling of the electronic device;

calculating an intensity adjustment for the at least one remaining portion of the input stream based on the luminous content, the estimated rate of cooling, and the current temperature, wherein the intensity adjustment establishes for the at least one remaining portion provides at least one of: an increase in luminosity level and a decrease in luminosity level; and applying the intensity adjustment to the input stream, wherein the intensity adjustment is applied for the duration of the at least one remaining portion.

20. The computer program product of claim 17, the program code further comprising code for:

determining whether the current temperature of the electronic display has exceeded at least one temperature threshold;

in response to determining that the current temperature has exceeded at least one temperature threshold, determining, based on the color profile, a modified electrical current to be applied to the electronic display that will reduce the current temperature to a temperature that does not exceed the at least one temperature threshold and which ensures the color content in the modified visual content is representative of the color content in the visual content; and applying the modified electrical current to the electronic display.

* * * * *